US009708803B1

(12) United States Patent
Lin et al.

(10) Patent No.: US 9,708,803 B1
(45) Date of Patent: Jul. 18, 2017

(54) POP-UP DRAIN STOPPER LINKAGE ASSEMBLY

(71) Applicant: Globe Union Industrial Corp., Taichung (TW)

(72) Inventors: Yiping Lin, Taichung (TW); Chunhung Li, Taichung (TW)

(73) Assignee: GLOBE UNION INDUSTRIAL CORP., Taichung (TW)

( * ) Notice: Subject to any disclaimer, the term of this patent is extended or adjusted under 35 U.S.C. 154(b) by 0 days.

(21) Appl. No.: 14/983,092

(22) Filed: Dec. 29, 2015

(51) Int. Cl.
*E03C 1/23* (2006.01)

(52) U.S. Cl.
CPC ..... *E03C 1/2302* (2013.01)

(58) Field of Classification Search
CPC ..... E03C 1/2302; E03C 1/23
See application file for complete search history.

(56) References Cited

U.S. PATENT DOCUMENTS 1,483,850 A * 2/1924 Kaufman ..... E03C 1/23 251/75
1,677,791 A * 7/1928 Mueller ..... E03C 1/23 4/691
1,704,510 A * 3/1929 Muend ..... E03C 1/23 4/685
1,758,226 A * 5/1930 Kaufman ..... E03C 1/23 251/75
1,848,521 A * 3/1932 Fleck ..... E03C 1/23 4/692
1,859,697 A * 5/1932 Fleck ..... E03C 1/23 4/692
1,958,992 A * 5/1934 Fraser ..... E03C 1/23 4/692
2,032,525 A * 3/1936 Brotz ..... E03C 1/23 4/651
2,327,393 A * 8/1943 Beeke ..... E03C 1/23 4/684
2010/0050337 A1* 3/2010 Li ..... E03C 1/2302 4/689

* cited by examiner

*Primary Examiner* — Janie Loeppke

(57) ABSTRACT

A pop-up drain stopper linkage assembly contains: a lift rod, a drain base, a connector, a threaded rod, a threaded sleeve, a driving rod, and a drain stopper. The lift rod is pulled upward or pressed downward by a user after extending through the basin. The drain base is disposed on the basin and includes an outlet. The connector is fixed on the drain base. The threaded rod is connected with the lift rod and moves vertically in response to the lift rod. The threaded sleeve screws with and moves vertically in response to the threaded rod and includes a first retaining portion. The driving rod includes a first segment, a second segment, a spherical ball, and plural second retaining portions. The drain stopper is secured on the drain base and includes a bottom end moving vertically in response to a lever movement of the driving rod.

11 Claims, 11 Drawing Sheets

POP-UP DRAIN STOPPER LINKAGE ASSEMBLY

FIELD OF THE INVENTION

The present invention relates to a basin accessory, and more particularly to a pop-up drain stopper linkage assembly adapted for the basin.

BACKGROUND OF THE INVENTION

A conventional pop-up drain stopper linkage assembly is disclosed in U.S. Pat. No. 8,136,179 B2 and contains: a lift rod fixed on a basin on which a faucet is mounted and configured to be pulled upward and pressed downward; a drain base screwed with a bottom of the basin and cooperating with a screwing element, the draining base including an outlet defined on a top thereof and a through hole formed on a peripheral side thereof; a connector connected with the through hole of the drain base; a coupling rod retained with a bottom of the lift rod and moving vertically in response to the lift rod, the coupling rod including a plurality of orifices formed thereon; a driving rod including a first segment, a second segment, and a spherical ball adjacent to the first segment and rotatably connected with the connector so as to form a fulcrum, wherein the first segment extends into the drain base from the through hole, the driving rod also includes plural fitting portions arranged proximate to the second segment, and one of the plural fitting portions selectively fits with one of the plurality of orifices on the coupling rod, such that the driving rod moves upward and downward in response to the coupling rod and causes a lever movement along the fulcrum; a drain stopper including a bottom end retaining with the first segment of the driving rod from the outlet of the drain base, and the drain stopper moving upward and downward in response to the lever movement of the driving rod, wherein the drain stopper moves downward, the outlet of the drain base is turned off, and when the drain stopper moves upward, the outlet of the drain base is turned off.

However, the coupling rod is removed from and is fitted with the first segment of the driving rod repeatedly, thus fixing the conventional pop-up drain stopper linkage assembly under the basin troublesomely.

A distance exits between any two adjacent orifices on the coupling rod, so the first segment of the driving rod cannot be adjustably moved on the coupling rod.

The driving rod selectively retains with the one of the plurality of orifices on the coupling rod by using the plural fitting portions, and a protrusion of any two adjacent fitting portions resists against the plurality of orifices, thus adjusting the driving rod difficultly.

The present invention has arisen to mitigate and/or obviate the afore-described disadvantages.

SUMMARY OF THE INVENTION

One aspect of the present invention is to provide a pop-up drain stopper linkage assembly which is fixed under the basin quickly and exactly, and a drain stopper moves upward or downward as a lift rod is pulled upward or is pressed downward, thus turning on/off an outlet of a drain base.

To obtain the above aspect, a pop-up drain stopper linkage assembly provided by a first embodiment of the present invention contains: a lift rod, a drain base, a connector, a threaded rod, a threaded sleeve, a driving rod, and a drain stopper.

The lift rod extends through a basin, and the lift rod is pulled upward or is pressed downward and is rotated by a user after extending through the basin.

The drain base is disposed on the basin and including an outlet.

The connector is fixed on the drain base.

The threaded rod includes a top end connected with a bottom end of the lift rod, and the threaded rod moves upward and downward and rotating in response to the lift rod.

The first threaded sleeve is configured to screw with the threaded rod and to move upward and downward along the threaded rod in response to a rotation of the threaded rod, the first threaded sleeve includes a first retaining portion formed on an outer wall thereof.

The fixing holder includes an aperture and a second retaining portion arranged on an outer wall thereof so as to retain with the first retaining portion.

The second threaded sleeve rotatably connects with the aperture of the fixing holder.

The driving rod includes a first segment, a second segment, a spherical ball formed adjacent to the first segment and rotatably connecting with the connector so as to form a fulcrum, and a screwing extension arranged proximate to the second segment so as to screw with the second threaded sleeve, such that the second threaded sleeve is rotated to move along the screwing extension, and the driving rod causes a lever movement along the fulcrum as the threaded rod moves upward and downward.

The drain stopper is secured on the drain base and includes a bottom end moving upward and downward in response to the lever movement of the driving rod, such that the outlet of the drain base turns on/off as the bottom end of the drain stopper moves upward and downward respectively.

In addition, a pop-up drain stopper linkage assembly provided by a second embodiment of the present invention contains: a lift rod, a drain base, a connector, a threaded rod, a first threaded sleeve, affixing holder, a second threaded sleeve, a driving rod, and a drain stopper.

The lift rod extends through a basin, and the lift rod is pulled upward or is pressed downward and is rotated by a user after extending through the basin.

The drain base is disposed on the basin and includes an outlet.

The connector is fixed on the drain base.

The threaded rod includes a top end connected with a bottom end of the lift rod, and the threaded rod moves upward and downward and rotates in response to the lift rod.

The first threaded sleeve is configured to screw with the threaded rod and to move upward and downward along the threaded rod in response to a rotation of the threaded rod, the first threaded sleeve includes a first retaining portion formed on an outer wall thereof.

The fixing holder includes an aperture and a second retaining portion arranged on an outer wall thereof so as to retain with the first retaining portion.

The second threaded sleeve rotatably connects with the aperture of the fixing holder.

The driving rod includes a first segment, a second segment, a spherical ball formed adjacent to the first segment and rotatably connecting with the connector so as to form a fulcrum, and a screwing extension arranged proximate to the second segment so as to screw with the second threaded sleeve, such that the second threaded sleeve is rotated to move along the screwing extension, and the driving rod causes a lever movement along the fulcrum as the threaded rod moves upward and downward.

The drain stopper is secured on the drain base and includes a bottom end moving upward and downward in response to the lever movement of the driving rod, such that the outlet of the drain base turns on/off as the bottom end of the drain stopper moves upward and downward respectively.

DETAILED DESCRIPTION OF THE PREFERRED EMBODIMENTS

Figure 1:
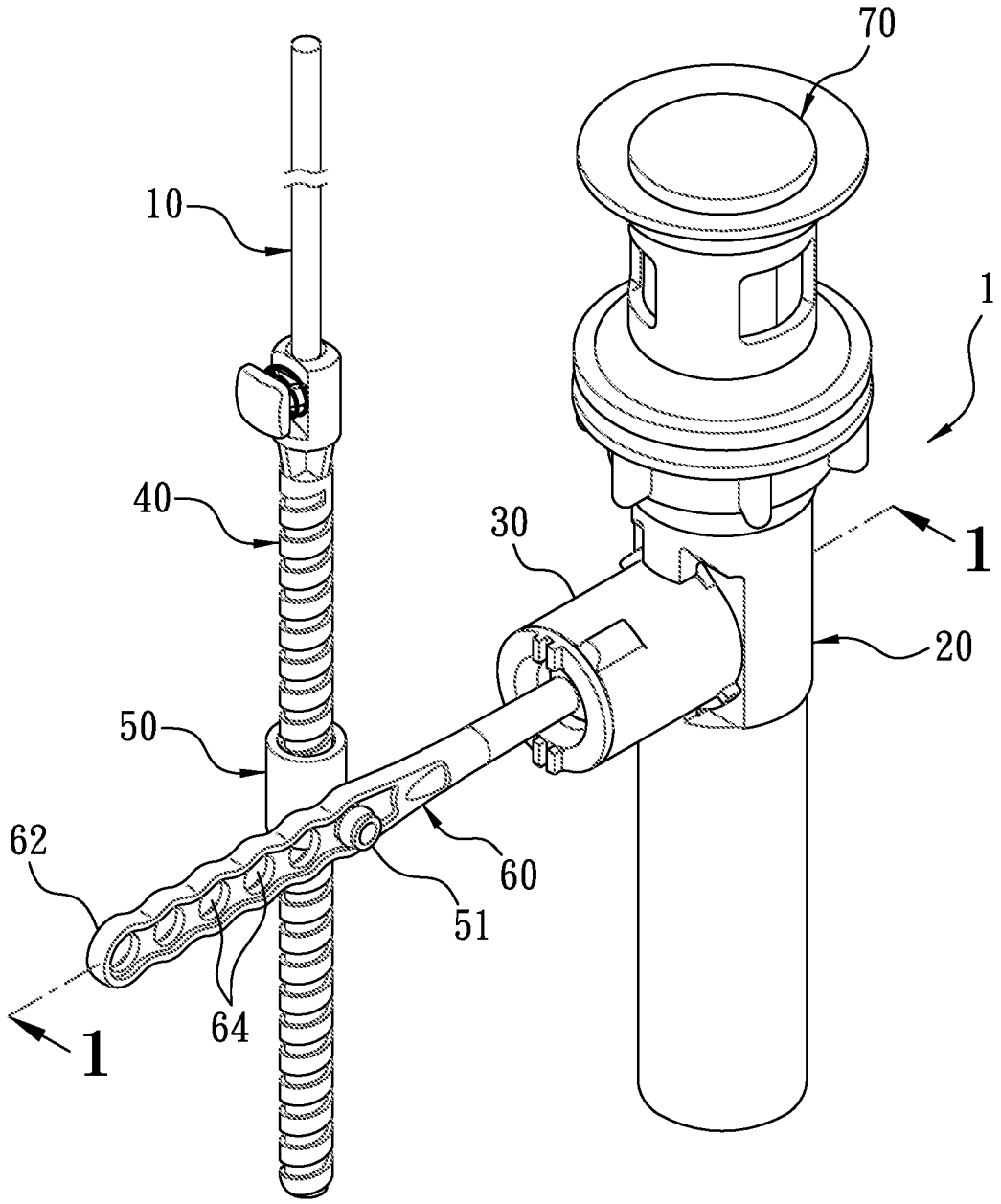
FIG. 1 is a perspective view showing the assembly of a pop-up drain stopper linkage assembly according to a first embodiment of the present invention.
Figure 2:
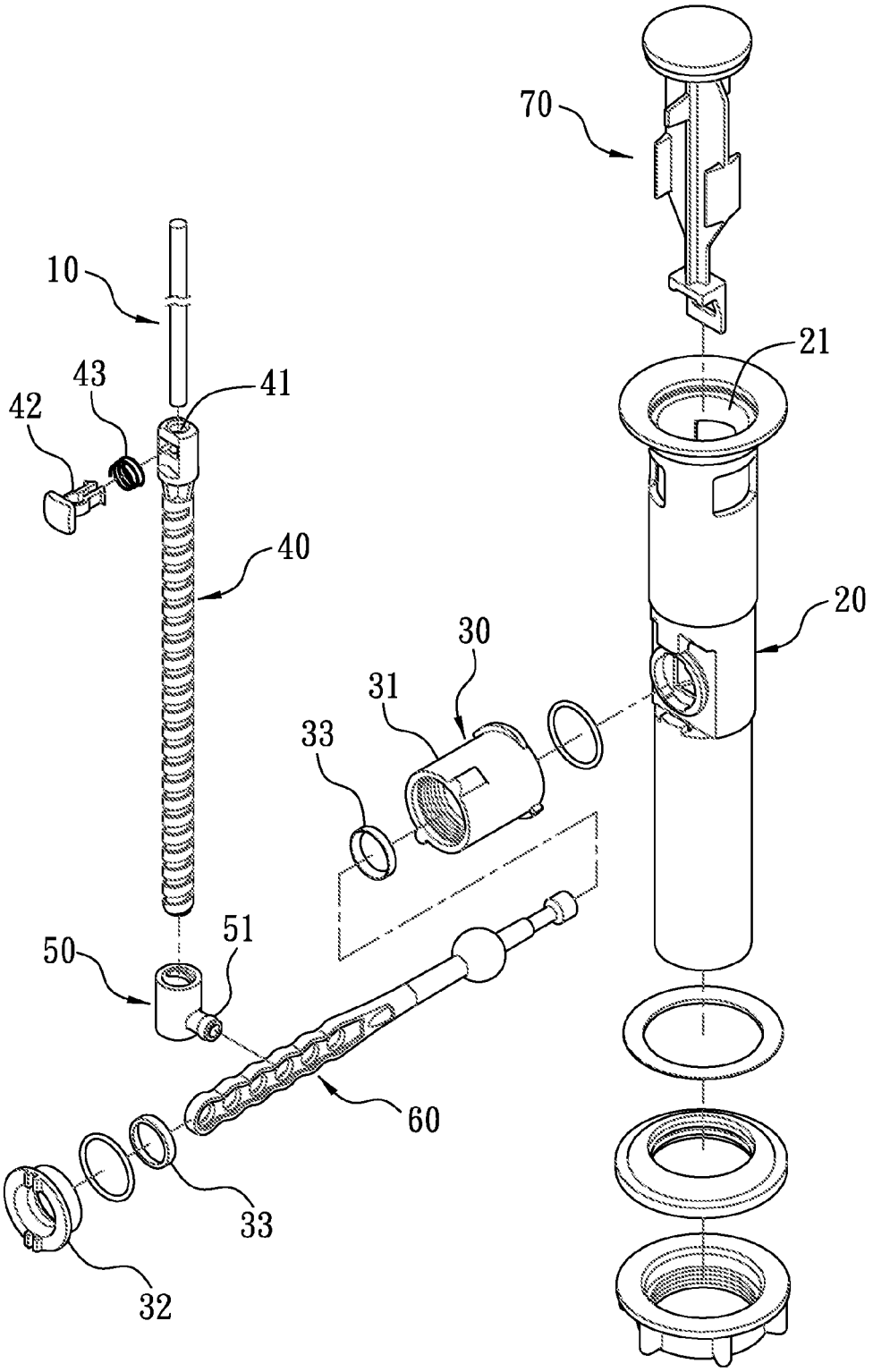
FIG. 2 is a perspective view showing the exploded components of the pop-up drain stopper linkage assembly according to the first embodiment of the present invention.
Figure 3:
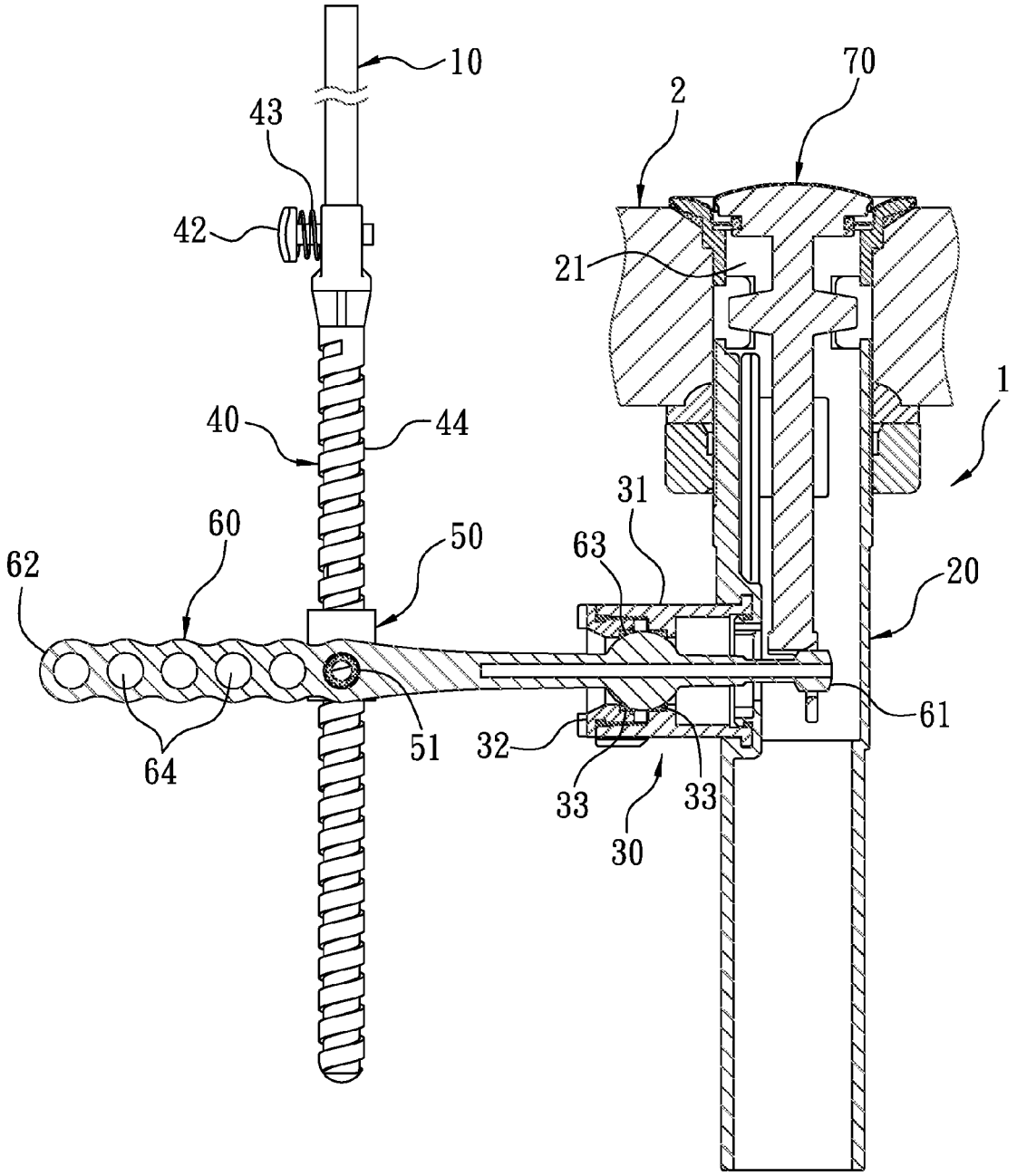
FIG. 3 is a cross sectional view taken along the line 1-1 of FIG. 1.

With reference to FIGS. 1 to 3, a pop-up drain stopper linkage assembly 1 according to a first embodiment of the present invention is adapted for a basin 2 and comprises: a lift rod 10, a drain base 20, a connector 30, a threaded rod 40, a threaded sleeve 50, a driving rod 60, and a drain stopper 70.

The lift rod 10 extends through the basin 2, and wherein when a faucet is mounted on the basin 2, the lift rod 10 also extends through the faucet, such that the lift rod 10 is pulled upward or is pressed downward and is rotated by a user after extending through the basin 2 or the faucet.

The drain base 20 is disposed on the basin 2 and includes an outlet 21.

The connector 30 is fixed on the drain base 20. In this embodiment, the connector 30 includes a body 31, a cap 32 screwing with the body 31, and two washers 33 matching with the body 31 and the cap 32 respectively, wherein the body 31 is rotatably retained with the drain base 20.

Figure 4:
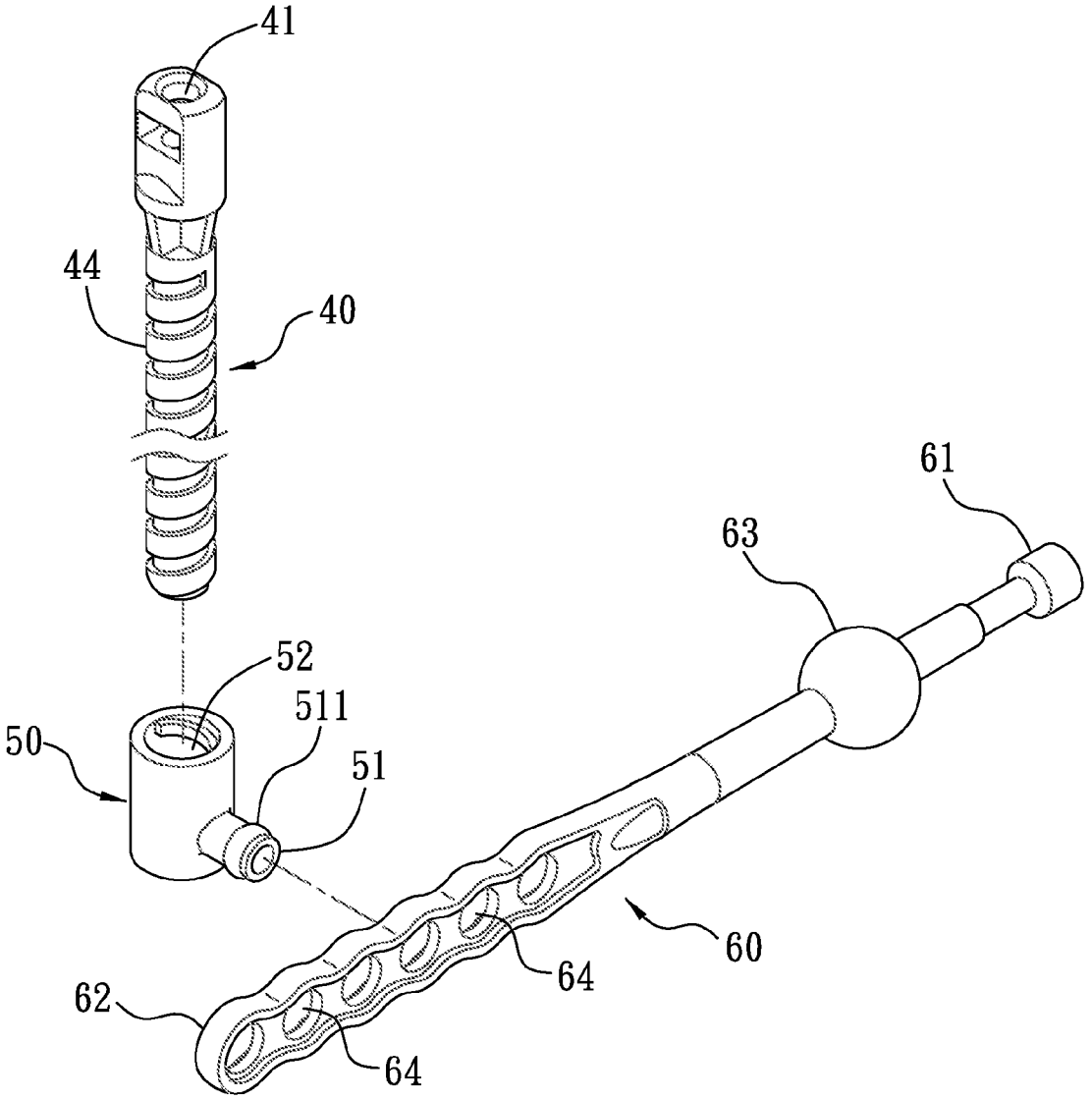
FIG. 4 is a perspective view showing the exploded components of a part of the pop-up drain stopper linkage assembly according to the first embodiment of the present invention.

As shown in FIG. 4, a top end of the threaded rod 40 is in connection with a bottom end of the lift rod 10, and the threaded rod 40 moves upward and downward and rotates in response to the lift rod 10. In this embodiment, the threaded rod 40 includes an orifice 41 longitudinally extending downward from a top end thereof so as to accommodate the bottom end of the lift rod 10, a fastener 42, a spring 43 acting on the fastener 42, and outer threads 44 formed on an outer wall of the threaded rod 40.

Figure 5:
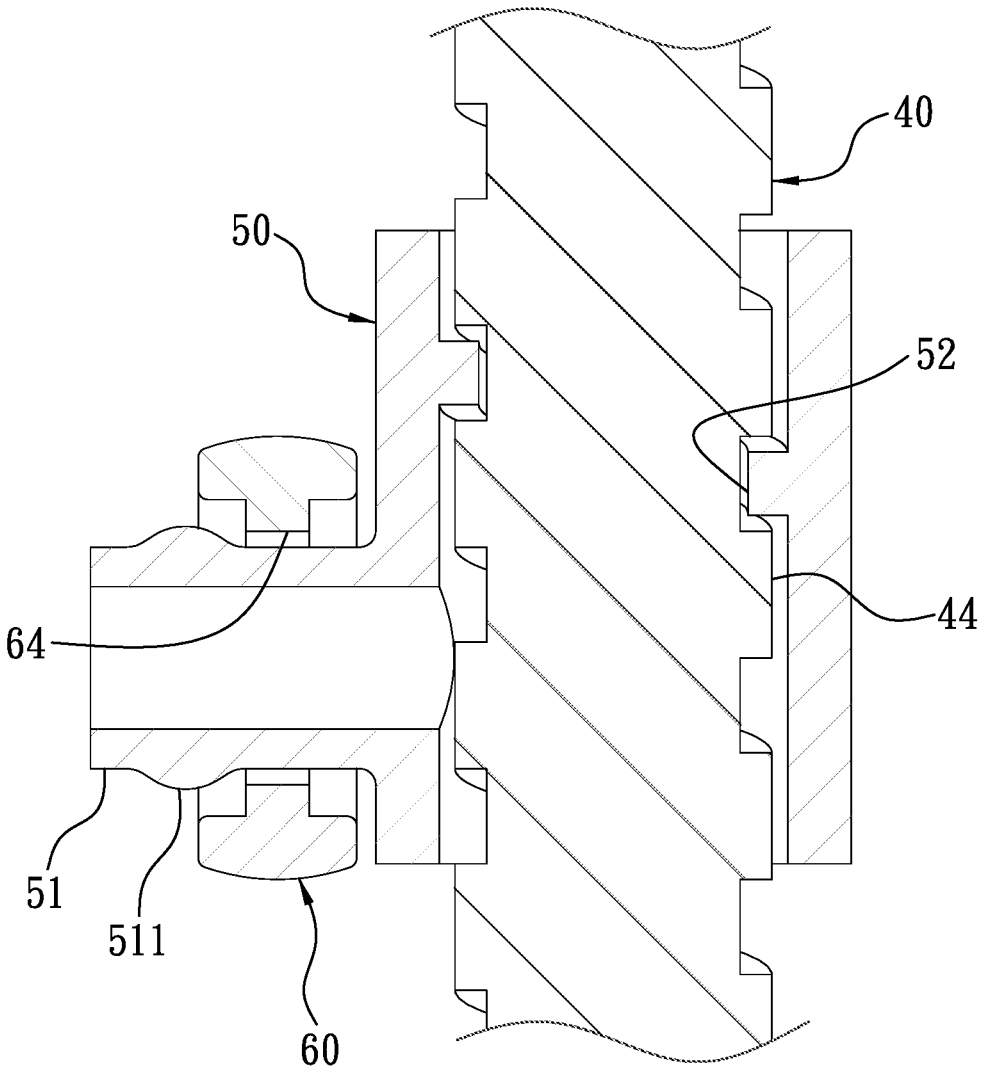
FIG. 5 is a cross sectional view showing the assembly of a part of the pop-up drain stopper linkage assembly according to the first embodiment of the present invention.

As illustrated in FIGS. 4 and 5, the threaded sleeve 50 screws with and moves upward and downward in response to the threaded rod 40, and the threaded sleeve 50 includes a first retaining portion 51 arranged on an outer wall thereof. In this embodiment, the first retaining portion 51 is a column extending outwardly from the outer wall of the threaded sleeve 50, and the column has a spherical surface 511. The threaded sleeve 50 includes inner threads 52 formed therein so as to screw with the outer threads 44 of the threaded rod 40.

The driving rod 60 includes a first segment 61, a second segment 62, a spherical ball 63 formed adjacent to the first segment 61 and rotatably connecting with the connector 30 so as to form a fulcrum, and plural second retaining portions 64 horizontally arranged proximate to the second segment 62 so that the first retaining portion 51 of the threaded sleeve 50 selectively retains with one of the plural second retaining portions 64, such that the driving rod 60 causes lever movement along the fulcrum as the threaded rod 40 moves upward and downward.

The spherical ball 63 is limited and rotates between the two washers 33 of the connector 30.

In this embodiment, each of the plural second retaining portions 64 is a locking hole so that the spherical surface 511 of the column selectively retains with the one of the plural second retaining portions 64. Preferably, the column rotates relative to the one of the plural second retaining portions 64, hence the threaded sleeve 50 moves upward and downward along the threaded rod 40 and is not limited by the driving rod 60.

The drain stopper 70 is secured on the drain base 20 and includes a bottom end moving upward and downward in response to the lever movement of the driving rod 60, such that the outlet 21 of the drain base 20 turns on/off as the bottom end of the drain stopper 70 moves upward and downward respectively.

Figure 6:
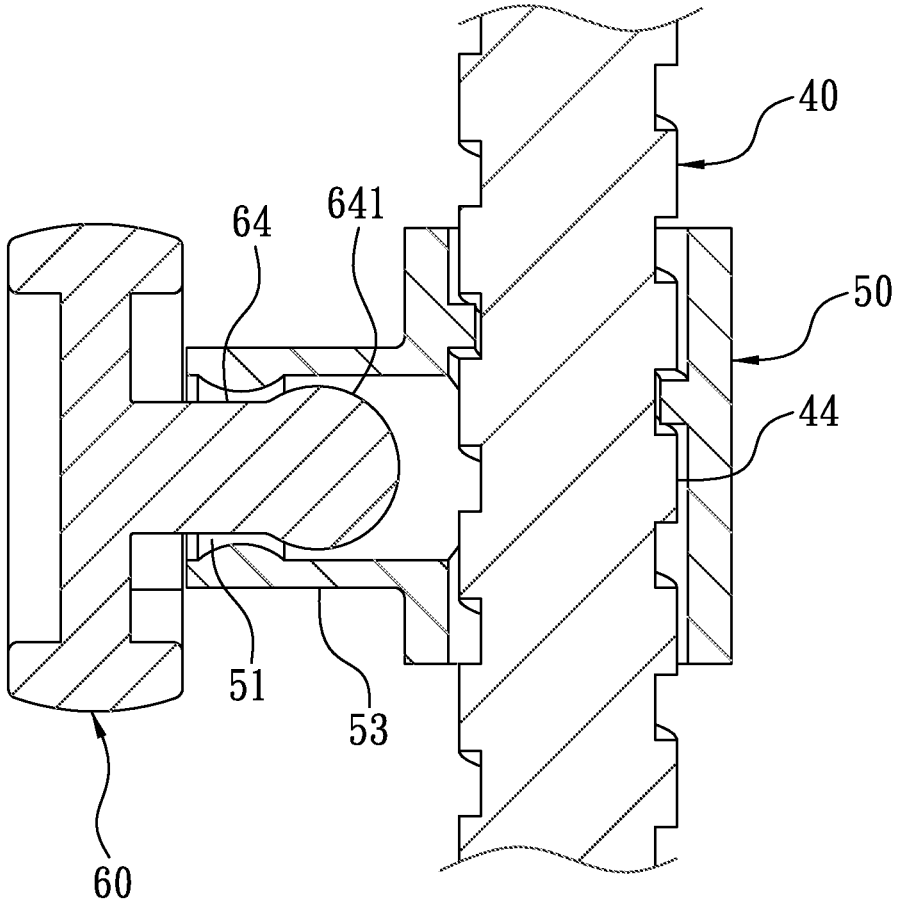
FIG. 6 is another cross sectional view showing the assembly of a part of the pop-up drain stopper linkage assembly according to the first embodiment of the present invention.

As shown in FIG. 6, in another embodiment, the first retaining portion 51 is a locking hole, and each of the plural second retaining portions 64 is a column, wherein the column has a spherical surface 641, the threaded sleeve 50 includes a fitting tube 53 extending outwardly from an outer wall thereof, and the fitting tube 53 has the locking hole defined therein, such that the spherical surface 641 of the column extends through the locking hole.

Referring to FIG. 3, in assembly, after the drain base 20, the drain stopper 70, and the driving rod 60 are fixed on the basin 2, the first retaining portion 51 of the threaded sleeve 50 (wherein threaded sleeve 50 is screwed with the threaded rod 40) is retained with the one of the plural second retaining portions 64 of the driving rod 60, and the lift rod 10, which extends through the basin 2 or the faucet, is rotated so as to adjustably position the threaded sleeve 50 on the threaded rod 40. Thereafter, the first retaining portion 51 is retained with another of the plural second retaining portions 64, hence the threaded rod 40, the threaded sleeve 50, and the driving rod 60 are connected together, and the drain stopper 70 moves upward or downward as the lift rod 10 is pulled upward or is pressed downward, thus turning on/off the outlet 21.

Figure 7:
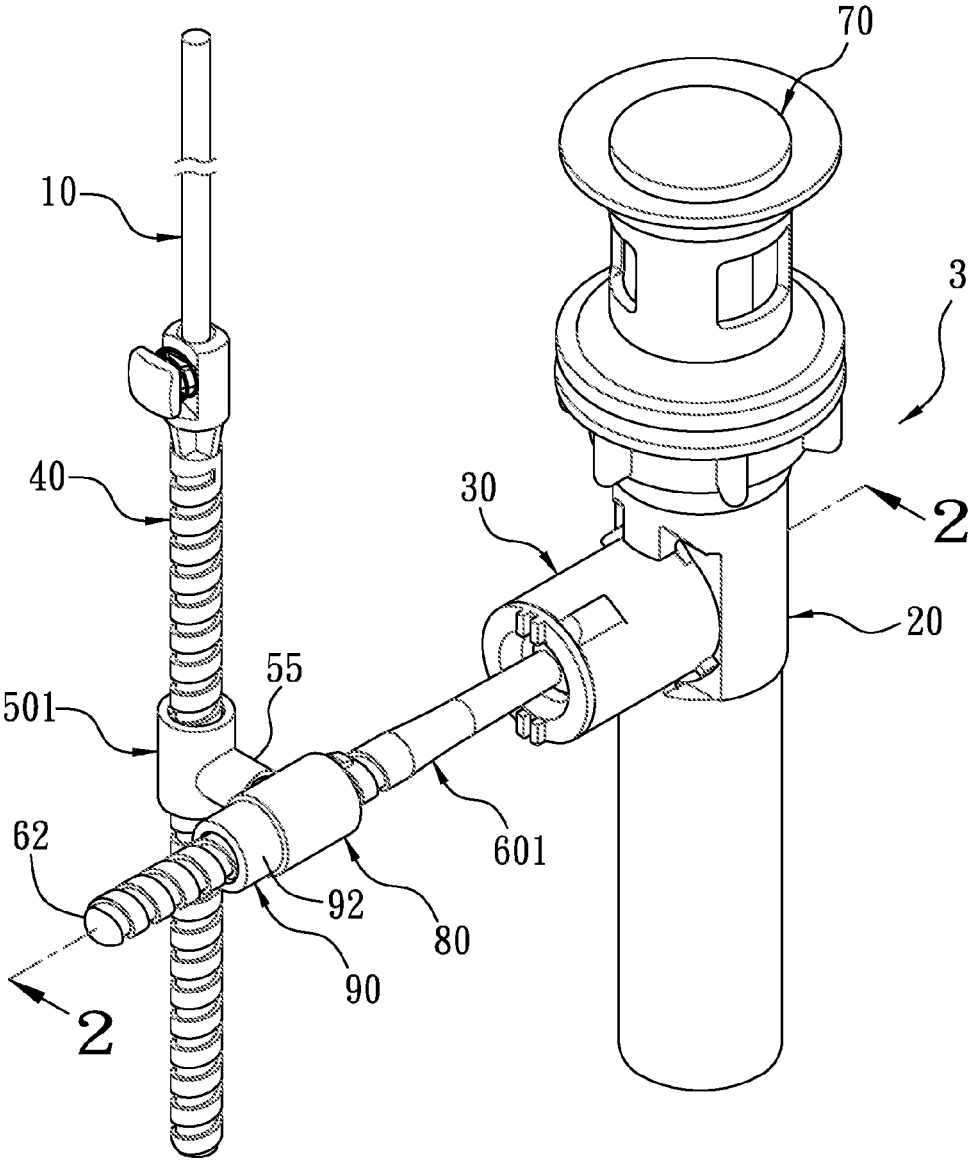
FIG. 7 is a perspective view showing the assembly of a pop-up drain stopper linkage assembly according to a second embodiment of the present invention.
Figure 8:
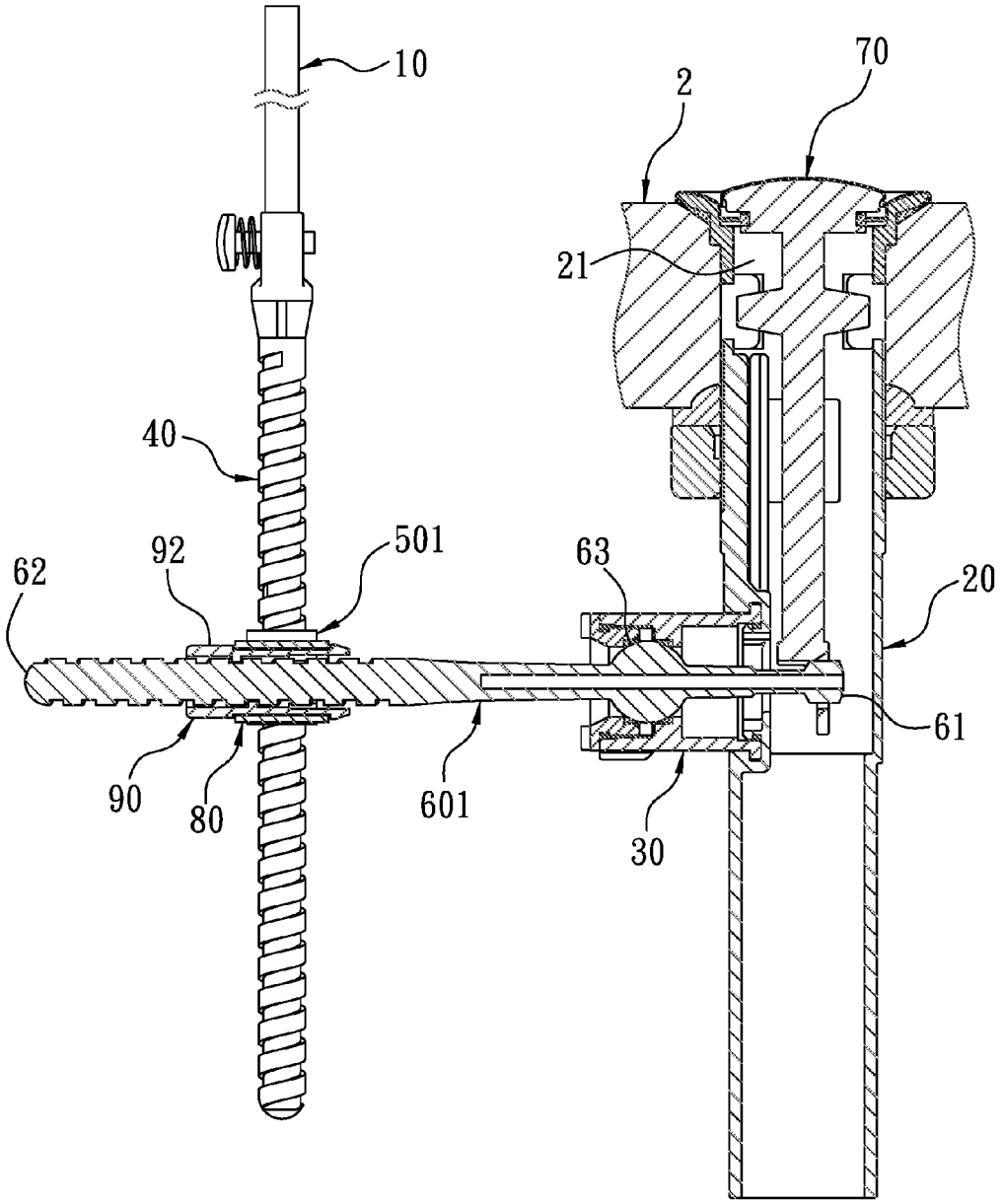
FIG. 8 is a cross sectional view taken along the line 2-2 of FIG. 7.
Figure 9:
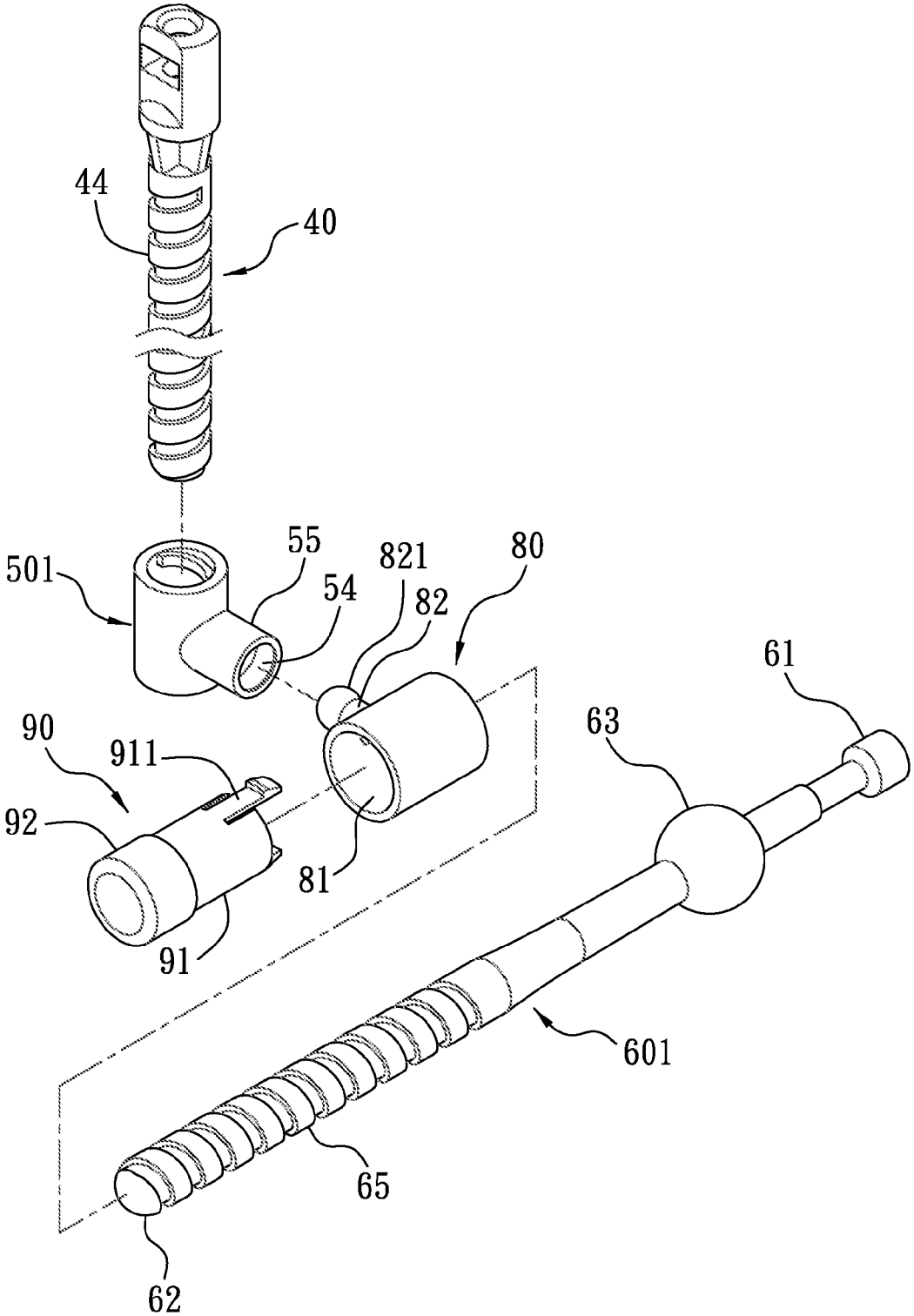
FIG. 9 is a perspective view showing the assembly of a part of the pop-up drain stopper linkage assembly according to the second embodiment of the present invention.

With reference to FIGS. 7 to 9, a difference of a pop-up drain stopper linkage assembly 3 of a second embodiment from that of the first embodiment comprises: a first threaded sleeve 501 configured to screw with the threaded rod 40 and to move upward and downward along the threaded rod 40 in response to a rotation of the threaded rod 40, and the first threaded sleeve 501 includes a first retaining portion 54 formed on an outer wall thereof, the first retaining portion 54 is a locking hole. Furthermore, the first threaded sleeve 501 includes a fitting tube 55 extending outwardly from an outer wall thereof, and the fitting tube 55 has the locking hole defined therein.

The pop-up drain stopper linkage assembly 3 further comprises a fixing holder 80, and the fixing holder 80 includes an aperture 81 and a second retaining portion 82 arranged on an outer wall thereof so as to retain with the first retaining portion 54. In this embodiment, the second retaining portion 82 is a column extending outwardly from the outer wall thereof, and the column has a spherical surface 821 configured to extend through the locking hole, the column rotates relative to the locking hole.

Figure 10:
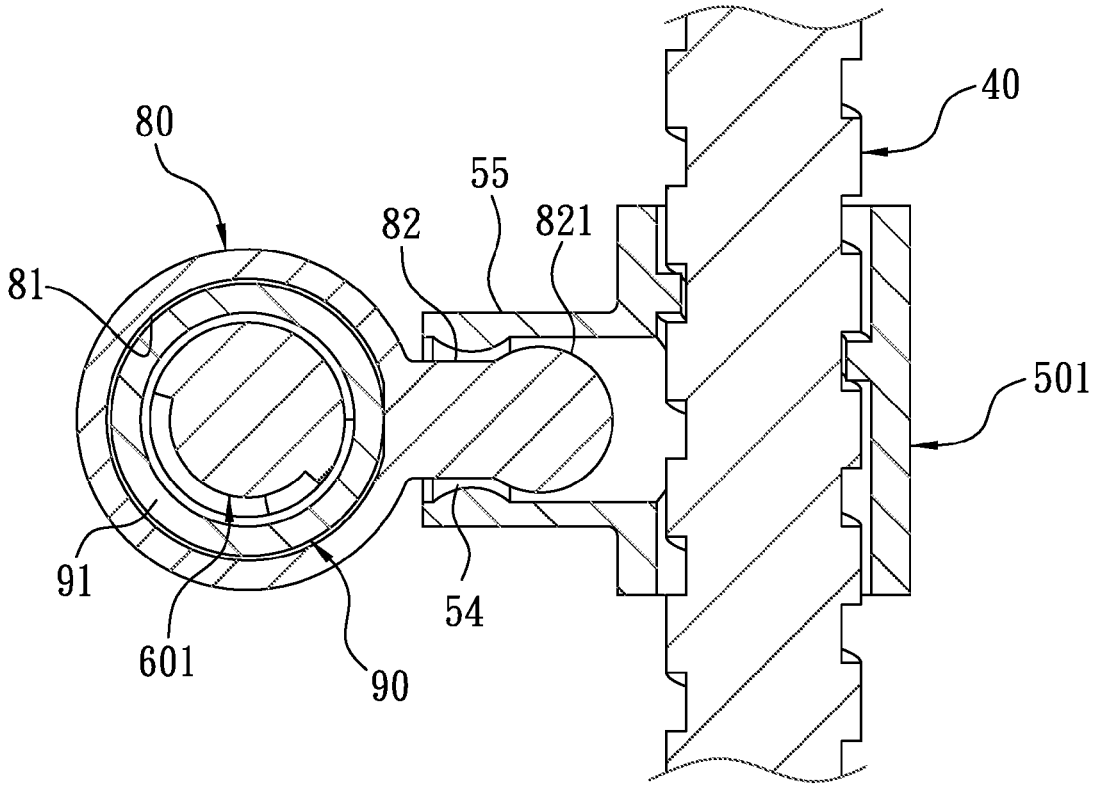
FIG. 10 is a cross sectional view showing the assembly of a part of the pop-up drain stopper linkage assembly according to the second embodiment of the present invention.
Figure 11:
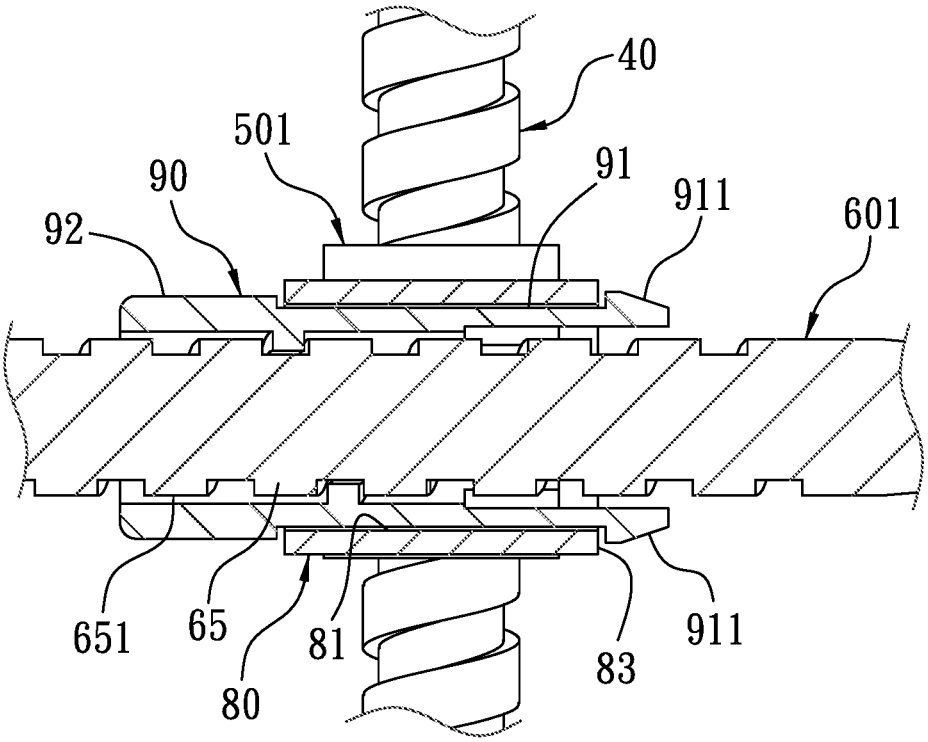
FIG. 11 is another cross sectional view showing the assembly of a part of the pop-up drain stopper linkage assembly according to the second embodiment of the present invention.

The pop-up drain stopper linkage assembly 3 further comprises a second threaded sleeve 90, as shown in FIGS. 10 and 11, wherein the second threaded sleeve 90 rotatably connects with the aperture 81 of the fixing holder 80.

Furthermore, the second threaded sleeve 90 includes a rotary stem 91 formed on an outer wall thereof and configured to rotatably connect with the aperture 81 of the fixing holder 80. The second threaded sleeve 90 also includes a rotary knob 92 configured to be rotated by the user.

The rotary stem 91 has two flexible hookers 911 symmetrically arranged on a free end thereof and retaining with an edge 83 of the fixing holder 80 via the aperture 81, such that the rotary stem 91 rotates in the aperture 81 of the fixing holder 80.

The pop-up drain stopper linkage assembly 3 further comprises a driving rod 601 with a screwing extension 65 configured to screw with the second threaded sleeve 90, such that the second threaded sleeve 90 is rotated to move along the screwing extension 65, and the driving rod 601 causes the lever movement along the fulcrum as the threaded rod 40 moves upward and downward.

In this embodiment, the first retaining portion 54 is a locking hole, and the second retaining portion 82 is a column. However, in anther embodiment, the first retaining portion 54 is a column, and the second retaining portion 82 is a locking hole.

In assembly, the rotary knob 92 of the second threaded sleeve 90 is rotated with user's fingers to control the second threaded sleeve 90 to move on the driving rod 601 easily, and the first threaded sleeve 501 is adjusted to move on the threaded rod 40, the second threaded sleeve 90 is adjusted to move on the driving rod 601 easily and exactly.

Thereby, the pop-up drain stopper linkage assembly is fixed under the basin quickly and exactly, and the drain stopper moves upward or downward quickly as the lift rod is pulled upward or is pressed downward, thus turning on/off the outlet.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A pop-up drain stopper linkage assembly adapted for a basin and comprising:

a lift rod extending through a basin, and the lift rod being pulled upward or pressed downward and being rotated by a user after extending through the basin;

a drain base disposed on the basin and including an outlet;

a connector fixed on the drain base;

a threaded rod including a top end connected with a bottom end of the lift rod, and the threaded rod moving upward and downward and rotating in response to the lift rod;

a threaded sleeve screwing with and moving upward and downward in response to the threaded rod, and the threaded sleeve including a first retaining portion arranged on an outer wall thereof, wherein the threaded rod inserts through the threaded sleeve;

a driving rod including a first segment, a second segment, a spherical ball formed adjacent to the first segment and rotatably connecting with the connector so as to form a fulcrum, and plural second retaining portions horizontally arranged proximate to the second segment so that the first retaining portion of the threaded sleeve selectively retains with one of the plural second retaining portions, such that the driving rod causes a lever movement along the fulcrum as the threaded rod moves upward and downward;

a drain stopper secured on the drain base and including a bottom end moving upward and downward in response to the lever movement of the driving rod, such that the outlet of the drain base turns on/off as the bottom end of the drain stopper moves upward and downward respectively;

wherein one of the first retaining portion and the second retaining portion is a column, and the other of the first retaining portion and the second retaining portion is a locking hole;

wherein the first retaining portion is a column extending outwardly from the outer wall of the threaded sleeve, and the plural second retaining portions are plural locking holes respectively so that the column selectively retains with one of the plural locking holes.

2. The pop-up drain stopper linkage assembly as claimed in claim 1, wherein the column has a spherical surface, and the spherical surface of the column extends through the locking hole.

3. A pop-up drain stopper linkage assembly adapted for a basin and comprising:

a lift rod extending through a basin, and the lift rod being pulled upward or pressed downward and being rotated by a user after extending through the basin;

a drain base disposed on the basin and including an outlet;

a connector fixed on the drain base;

a threaded rod including a top end connected with a bottom end of the lift rod, and the threaded rod moving upward and downward and rotating in response to the lift rod;

a threaded sleeve screwing with and moving upward and downward in response to the threaded rod, and the threaded sleeve including a first retaining portion arranged on an outer wall thereof, wherein threaded rod inserts through the threaded sleeve;

a driving rod including a first segment, a second segment, a spherical ball formed adjacent to the first segment and rotatably connecting with the connector so as to form a fulcrum, and plural second retaining portions horizontally arranged proximate to the second segment so that the first retaining portion of the threaded sleeve selectively retains with one of the plural second retaining portions, such that the driving rod causes a lever movement along the fulcrum as the threaded rod moves upward and downward;

a drain stopper secured on the drain base and including a bottom end moving upward and downward in response to the lever movement of the driving rod, such that the outlet of the drain base turns on/off as the bottom end of the drain stopper moves upward and downward respectively;

wherein one of the first retaining portion and the second retaining portion is a column, and the other of the first retaining portion and the second retaining portion is a locking hole;

wherein the first retaining portion is a fitting tube extending outwardly from the outer wall of the threaded sleeve, and the fitting tube has the locking hole defined therein; the plural second retaining portions are plural columns respectively so that the locking hole selectively retains with one of the plural columns.

4. The pop-up drain stopper linkage assembly as claimed in claim 3, wherein the column has a spherical surface, and the spherical surface of the column extends through the locking hole.

5. A pop-up drain stopper linkage assembly adapted for a basin and comprising:

a lift rod extending through a basin, and the lift rod being pulled upward or pressed downward and being rotated by a user after extending through the basin;

a drain base disposed on the basin and including an outlet;

a connector fixed on the drain base;

a threaded rod including a top end connected with a bottom end of the lift rod, and the threaded rod moving upward and downward and rotating in response to the lift rod;

a first threaded sleeve configured to screw with the threaded rod and to move upward and downward along the threaded rod in response to a rotation of the threaded rod, the first threaded sleeve including a first retaining portion formed on an outer wall thereof;

a fixing holder including an aperture and a second retaining portion arranged on an outer wall thereof so as to retain with the first retaining portion;

a second threaded sleeve rotatably connecting with the aperture of the fixing holder;

a driving rod including a first segment, a second segment, a spherical ball formed adjacent to the first segment and rotatably connecting with the connector so as to form a fulcrum, and a screwing extension arranged proximate to the second segment so as to screw with the second threaded sleeve, such that the second threaded sleeve is rotated to move along the screwing extension, and the driving rod causes a lever movement along the fulcrum as the threaded rod moves upward and downward;

a drain stopper secured on the drain base and including a bottom end moving upward and downward in response to the lever movement of the driving rod, such that the outlet of the drain base turns on/off as the bottom end of the drain stopper moves upward and downward respectively.

6. The pop-up drain stopper linkage assembly as claimed in claim 5, wherein one of the first retaining portion and the second retaining portion is a column, and the other of the first retaining portion and the second retaining portion is a locking hole.

7. The pop-up drain stopper linkage assembly as claimed in claim 6, wherein the first retaining portion is a fitting tube extending outwardly from the outer wall of the first threaded sleeve, and the fitting tube has the locking hole defined therein; the second retaining portion is the column extending outwardly from the outer wall of the fixing holder so that the column retains with the locking hole.

8. The pop-up drain stopper linkage assembly as claimed in claim 6, wherein the first retaining portion is the column extending outwardly from the outer wall of the first threaded sleeve; the second retaining portion is a fitting tube extending outwardly from the outer wall of the fixing holder, and the fitting tube has the locking hole defined therein, wherein the column retains with the locking hole.

9. The pop-up drain stopper linkage assembly as claimed in claim 6, wherein the column has a spherical surface, and the spherical surface of the column extends through the locking hole.

10. The pop-up drain stopper linkage assembly as claimed in claim 5, wherein the second threaded sleeve includes a rotary stem formed on an outer wall thereof and configured to rotatably connect with the aperture of the fixing holder; the second threaded sleeve also includes a rotary knob configured to be rotated by the user.

11. The pop-up drain stopper linkage assembly as claimed in claim 10, wherein the rotary stem has two flexible hookers symmetrically arranged on a free end thereof and retaining with an edge of the fixing holder via the aperture, such that the rotary stem rotates in the aperture of the fixing holder.

* * * * *